United States Patent [19]

Busacca et al.

[11] 4,256,990

[45] Mar. 17, 1981

[54] COOLING SYSTEM FOR TUNABLE MICROWAVE GENERATOR

[76] Inventors: Guido Busacca, Via Notarbartolo 35; Pietro Luparello, Via E. Leotta 15; Vincenzo Meli, Via F. Cilea 97, all of Palermo, Italy

[21] Appl. No.: 31,582

[22] Filed: Apr. 19, 1979

Related U.S. Application Data

[63] Continuation-in-part of Ser. No. 16,531, Mar. 1, 1977, abandoned.

[30] Foreign Application Priority Data

Mar. 6, 1978 [IT] Italy ..... 20903 A/78

[51] Int. Cl.[3] ..... H01J 25/50

[52] U.S. Cl. ..... 315/39.61; 313/22; 313/30; 313/34; 315/39.51

[58] Field of Search ..... 315/39.51, 39.61; 313/22, 28, 30, 32, 34

[56] References Cited

U.S. PATENT DOCUMENTS

| | | | |
|---|---|---|---|
| 2,496,887 | 2/1950 | Nelson | 315/39.51 |
| 2,512,901 | 6/1950 | Litton | 315/39.51 |
| 2,523,049 | 9/1950 | Nelson | 313/32 X |
| 2,554,272 | 5/1951 | Sloan | 313/32 X |
| 2,678,407 | 5/1954 | Brown | 313/32 X |
| 3,707,639 | 12/1972 | Pickering | 313/30 |
| 4,028,583 | 6/1977 | Bigham | 313/34 |

*Primary Examiner*—Saxfield Chatmon, Jr.
*Attorney, Agent, or Firm*—Karl F. Ross

[57] ABSTRACT

A magnetron with a central cathode coaxially surrounded by an annular anode forming an array of cylindrical resonant cavities is tunable by an axially movable disk carrying hollow plungers which project into these cylinders, the disk being spacedly overlain by a lid or wall member defining therewith a shallow chamber for the circulation of a cooling fluid. The fluid enters and leaves via expandable inlet and outlet channels to traverse not only the chamber but also the interior of the several plungers. The axial adjustment of the disk is brought about by rotation of a ring with an internally threaded hub engaging a complementarily threaded hollow boss rigid with the disk, the chamber communicating with the interior of the boss through peripheral apertures of the latter. The fluid is branched off a hydraulic circuit for the cooling of the stationary electrode structure formed by the anode and the cathode.

4 Claims, 3 Drawing Figures

FIG. 1
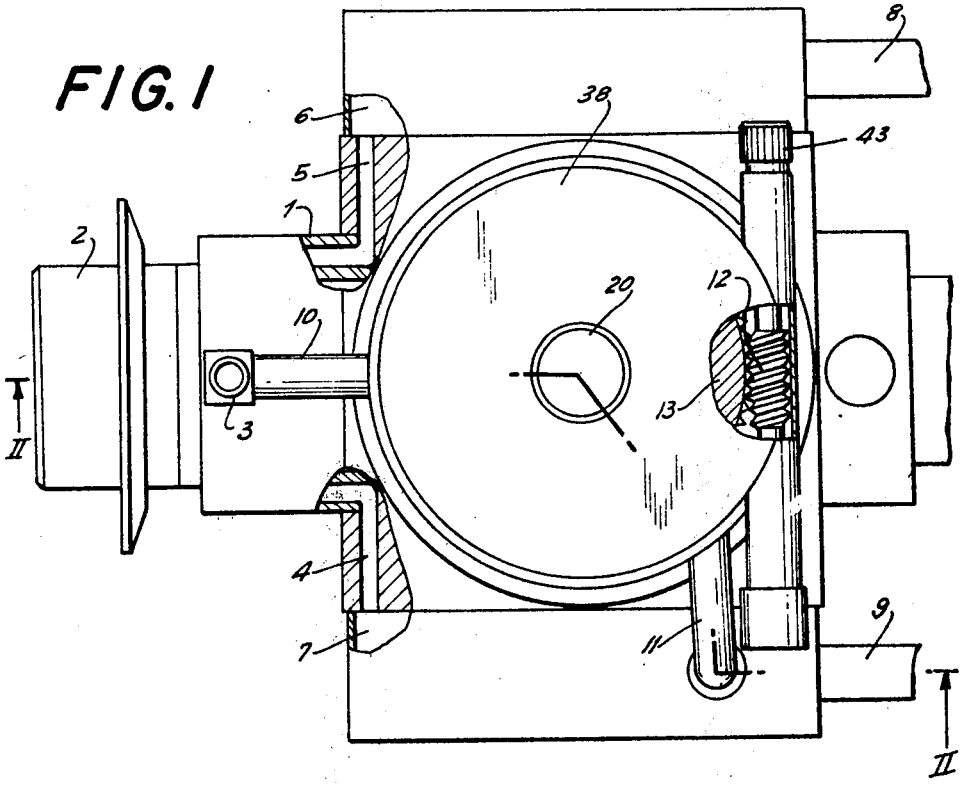
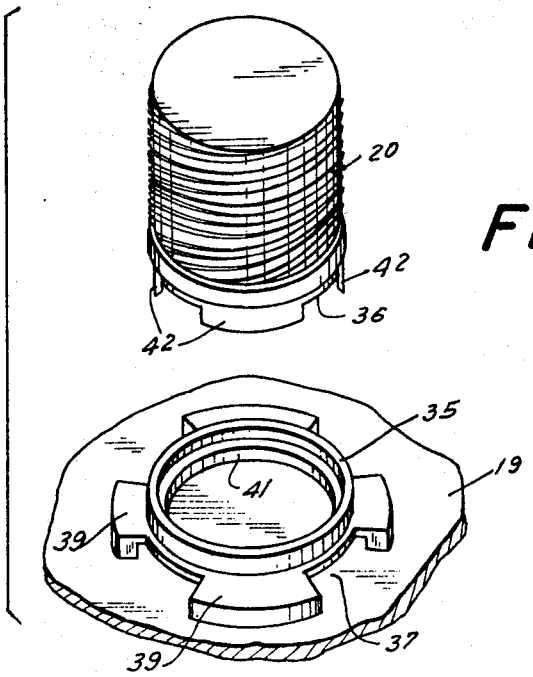
FIG. 3

COOLING SYSTEM FOR TUNABLE MICROWAVE GENERATOR

CROSS-REFERENCE TO A RELATED APPLICATION

This is a continuation-in-part of our copending patent application Ser. No. 016,531 filed Mar. 1, 1977 and now abandoned.

FIELD OF THE INVENTION

Our present invention relates to a cooling system for a tunable microwave generator such as a cavity magnetron.

BACKGROUND OF THE INVENTION

A microwave generator of the type here contemplated comprises a stationary electrode structure in a housing, this structure forming an array of evacuated resonant cavities centered on an axis. In order to adjust the frequency of the generated microwaves, each cavity is provided with a metallic plunger which can be introduced into it to a greater or lesser extend through the axial displacement of a tuning disk rigid with these plungers. The cavities and their plungers are usually cylindrical and are separated from each other by a small annular clearance. Thus, the plungers must be precisely guided and must not undergo any significant dimensional changes in order to avoid short circuits, arcing or spurious resonances due to parasitic capacitances. Severe defromations may even result in a jamming of the plungers in their cavities.

Since the operation of a magnetron-type oscillator generates considerable heat, the apparatus must be effectively cooled to prevent such dimensional changes. Heretofore, separate cooling means have been used for the stationary components, including the electrode structure, and the movable components, i.e. the tuning mechanism. In one such conventional system, hydraulic fluid is circulated around the anode and cathode of the electrode structure, which constitutes the principal heat source, whereas the tuning device is air-cooled by means of a finned hollow cylinder which rests on the movable disk and is filled with a heat-exchanging fluid.

While the use of a dual cooling system obviates the problem of fluidically linking the stationary and movable components of the magnetron, its drawback is the limited thermal capacity of the aforedescribed heat exchanger which may cause overheating of the plungers with all the attendant difficulties.

OBJECT OF THE INVENTION

The object of our present invention, therefore, is to provide a more effective cooling system for the tuning mechanism of a microwave generator such as a cavity magnetron.

SUMMARY OF THE INVENTION

In accordance with our present invention, the tuning disk carrying the plungers is spacedly overlain by a lid or wall member rigid therewith, the disk and the lid bounding a shallow chamber which is isolated from the cavities and extends across its plungers. A preferably hydraulic fluid is circulated by conduit means, which may include expandable inlet and outlet channels, through the chamber as well through the interior of the hollow plungers; the expandable channels can be formed by bellows inserted between the lid and a stationary housing part.

Although in principle the fluid for the cooling chamber of the tuning disk may come from a separate source, we prefer to branch it off a hydraulic duct system serving for the circulation of liquid around the electrode structure.

BRIEF DESCRIPTION OF THE DRAWING

The above and other features of our invention will now be described in detail with reference to the accompanying drawing in which:

FIG. 1 is a top plan view (with parts broken away) of a cavity magnetron embodying our invention;

FIG. 3 is an exploded axonometric view of certain parts of a tuning mechanism included in the magentron.

SPECIFIC DESCRIPTION

Figure 2:
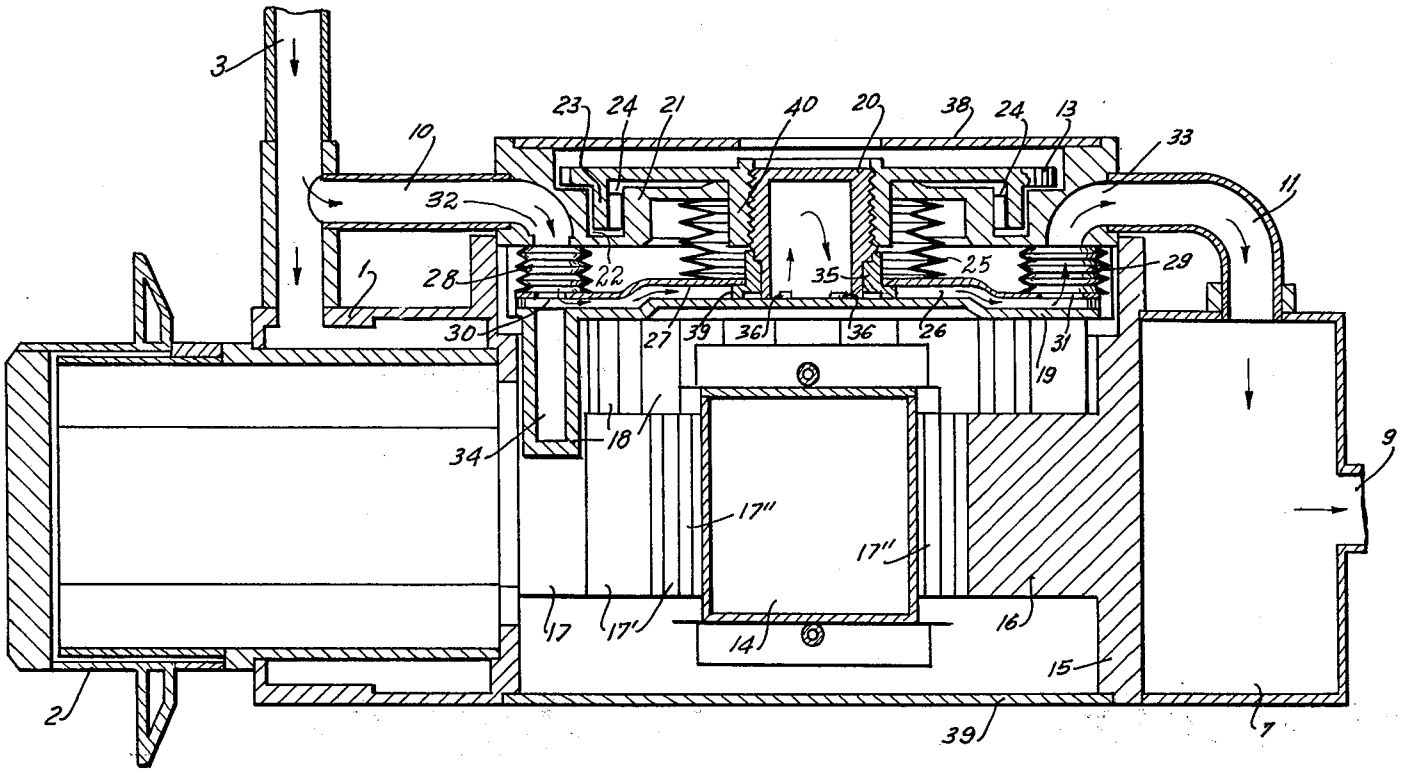
FIG. 2 is a cross-sectional view taken on the line II—II of FIG. 1.

As shown in FIGS. 1 and 2, a stationary housing 1 surrounds an electrode structure comprising a central cathode 14 which is coaxially surrounded by an annular anode 15. The latter is divided into an even number of sectors 16 separated by radial slots 17' which connect an interaction space 17'' with as many cylindrical resonant cavities 17 as is well known per se. The interior of the housing, closed against the atmosphere by a bottom plate 39 and by an axially movable tuning disk 19, is evacuated and so is a waveguide 2 which extends radially into the housing and communicates with the cavities 17 in conventional manner to extract the generated microwaves.

The stationary components including cathode 14, anode 15 and waveguide 2 are cooled by liquid entering the housing through an intake duct 3 and flowing through passages 4 and 5 into a pair of lateral compartments 6 and 7 with outlets 8 and 9. A pipe 10 branches off the intake duct 3 and opens into a port 32 giving access to an expandable inlet channel defined by a bellows 28. Another bellows 29 forms an expandable outlet channel communicating with a port 33 connected via a tube 11 with compartment 7 and thus with discharge duct 9.

Tuning disk 19 supports a multiplicity of hollow cylindrical plungers 13 which extend into respective cavities 17 for varying their effective volume upon an axial displacement of the disk. The interior 34 of each plunger communicates at its top with a narrow chamber 26 formed by the disk 19 and an overlying lid 27 rigid and coextensive with that disk, the bellows 28 and 29 resting on that lid in line with respective openings 30 and 31 through which cooling liquid can enter and leave the chamber at widely separated locations near the periphery of disk 19.

The disk 19 is further connected, in a manner more fully described hereinafter, with a hollow central boss 20 which penetrates the lid 27 and is externally threaded for engagement by a nut in the shape of an internally threaded hub 40 of a ring 13 provided with peripheral gear teeth which mesh with the threads of a worm 12 having an adjusting knob 43. Ring 13, overlain by a cover 38, has a peripheral flange 23 received in an annular recess 22 of a housing part 21 in which the ring is journaled by bearing rollers 24. A further bellows 25 surrounds the hub 40 and boss 20 between the housing part 21 and the lid 27 to act as an additional seal against fluid leakage.

As best seen in FIG. 3, the disk 19 is provided with a central collar 35 elevated above its surface by several legs 39 separated by gaps 37. Collar 35 has an internal shoulder 41 forming a seat for the boss 20 which has legs 42 coming to rest on disk 19, these legs being separated by gaps 36 in line with the gaps 37 of the collar to let cooling liquid pass from chamber 26 into the interior of boss 20 and out again as indicated by arrows in FIG. 2. Lid 27 rests on the legs 39 and, like boss 20, may be secured to the collar 35 by soldering, for example.

Rotation of worn 43 by means of knob 12' turns the ring 13 relatively to the nonrotatable assembly 19, 20, 27 which is thereby axially displaced along with plungers 18 to tune the magnetron by varying the effective volume of its cavities 17. Liquid pumped in through intake duct 3 passes on the one hand into compartments 6 and 7 to cool the stationary components of the magnetron and on the other hand via branch pipe 10 into chamber 26 which it leaves through pipe 11, the heated liquid and vapors exiting at discharge ducts 8 and 9. The branched-off flow also reaches into the interior 34 of each plunger 18 as well as into the hollow boss 20 for effectively cooling same.

We claim:

1. In a microwave generator including a stationary electrode structure forming an array of evacuated resonant cavities centered on an axis inside a housing, a tuning disk transverse to said axis in said housing provided with a set of hollow plungers respectively extending into said cavities, and adjusting means coupled with said tuning disk for axially displacing same together with said hollow plungers for varying the frequency of the generated microwaves, the combination therewith of a wall member in said housing spacedly overlying said disk and rigid therewith, said disk and said wall member bounding a shallow chamber isolated from said cavities and extending across and communicating with the interior of said hollow plungers, and conduit means forming a path for the circulation of a cooling fluid through said chamber and said hollow plungers between an inlet and an outlet at spaced-apart locations near the periphery of said disk.

2. The combination defined in claim 1 wherein said adjusting means comprises an externally threaded hollow boss rising centrally from said disk and a rotatable nut engaging said boss, said chamber communicating with the interior of said boss through peripheral apertures in the latter.

3. The combination defined in claim 1 or 2 wherein said conduit means includes an expandable inlet channel and an expandable outlet channel extending axially between said wall member and a stationary part of said housing.

4. The combination defined in claim 3 wherein said housing is provided with a duct system for the circulation of cooling fluid around said electrode structure, said conduit means further including a branch line of said duct system opening into said inlet channel.

* * * * *